US009209559B2

(12) United States Patent
Hodge et al.

(10) Patent No.: US 9,209,559 B2
(45) Date of Patent: Dec. 8, 2015

(54) POWER CONNECTOR

(75) Inventors: Ronald C. Hodge, Aurora, IL (US); Victor Zaderej, St. Charles, IL (US); Joseph D. Comerci, Elmhurst, IL (US)

(73) Assignee: Molex, LLC, Lisle, IL (US)

( * ) Notice: Subject to any disclaimer, the term of this patent is extended or adjusted under 35 U.S.C. 154(b) by 115 days.

(21) Appl. No.: 14/117,407

(22) PCT Filed: May 14, 2012

(86) PCT No.: PCT/US2012/037781

§ 371 (c)(1), (2), (4) Date: Aug. 20, 2014

(87) PCT Pub. No.: WO2012/158616

PCT Pub. Date: Nov. 22, 2012

(65) Prior Publication Data

US 2014/0363987 A1 Dec. 11, 2014

Related U.S. Application Data

(60) Provisional application No. 61/486,094, filed on May 13, 2011.

(51) Int. Cl.

| | |
|---|---|
| ***H01R 11/30*** | (2006.01) |
| ***H01R 13/62*** | (2006.01) |
| ***H01R 13/04*** | (2006.01) |
| *H01R 13/627* | (2006.01) |

(52) U.S. Cl.

CPC ..... *H01R 13/6205* (2013.01); *H01R 13/04* (2013.01); *H01R 11/30* (2013.01); *H01R 13/6271* (2013.01)

(58) Field of Classification Search

CPC ..... H01R 13/6205; H01R 11/30

See application file for complete search history.

(56) References Cited

U.S. PATENT DOCUMENTS

| | | | | |
|---|---|---|---|---|
| 4,211,456 | A | 7/1980 | Sears | |
| 5,358,417 | A | 10/1994 | Schmedding | |
| 5,586,668 | A | 12/1996 | Miller | |
| 6,350,076 | B1 * | 2/2002 | Wagner et al. | 403/135 |
| 6,497,364 | B1 | 12/2002 | Harsu | |
| 2004/0038576 | A1 | 2/2004 | Draggie et al. | |
| 2005/0059276 | A1 | 3/2005 | Lee et al. | |
| 2009/0068858 | A1 | 3/2009 | Di Stefano | |

(Continued)

FOREIGN PATENT DOCUMENTS

| | | | |
|---|---|---|---|
| JP | 2000-353571 | A | 12/2000 |
| JP | 2002-352884 | A | 12/2002 |
| JP | 2004-103881 | A | 4/2004 |

OTHER PUBLICATIONS

International Search Report for PCT/US2012/037781.

*Primary Examiner* — Gary Paumen

(74) *Attorney, Agent, or Firm* — Stephen L. Sheldon

(57) ABSTRACT

A connector system includes a first connector with a housing. The housing supports a terminal with an aperture that is positioned adjacent a pocket. A ball is positioned in the pocket and is restrained by the terminal but is configured to partially extend through the aperture. A second connector includes a contact and a magnet attraction member. In operation, when the first and second connector are in a mated position, the ball is urged toward the magnetic attraction member due to a magnetic force and partially extends through the aperture so as to engage the contact, electrically connecting the terminal and the contact.

7 Claims, 12 Drawing Sheets

(56) References Cited

U.S. PATENT DOCUMENTS

2010/0197148 A1 8/2010 Rudisill et al.
2011/0076891 A1 3/2011 Kim et al.
2011/0189863 A1* 8/2011 Sare et al. ..... 439/39
2012/0071008 A1* 3/2012 Sessford ..... 439/39
2013/0323941 A1* 12/2013 Zeliff et al. ..... 439/39

* cited by examiner

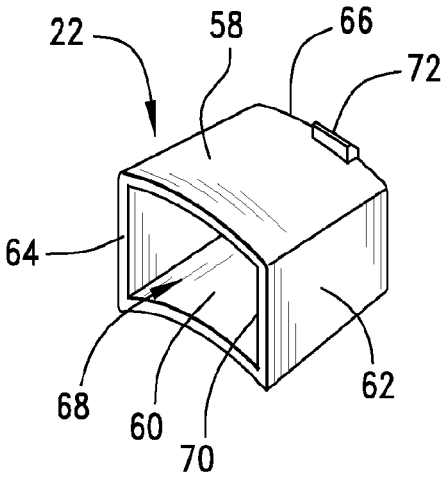
FIG.3
FIG.4
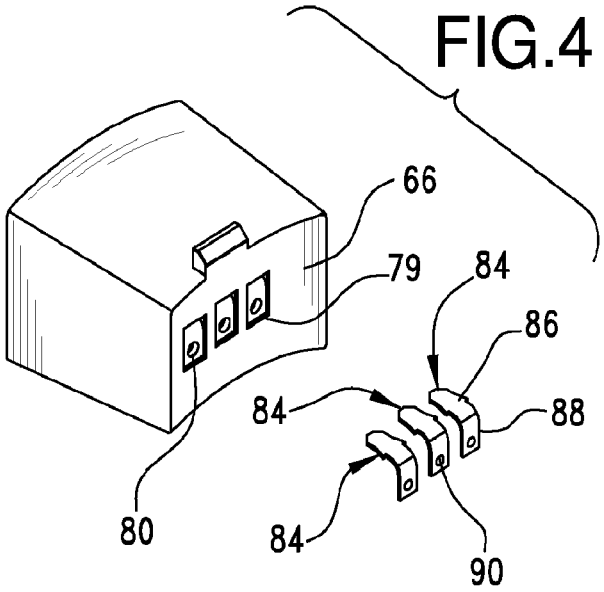
FIG.5
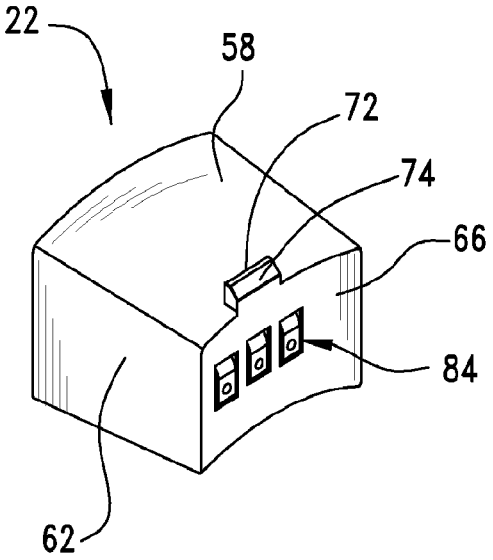

POWER CONNECTOR

RELATED APPLICATIONS

This application claims priority to U.S. Provisional Application No. 61/486,094, filed May 13, 2010, which is incorporated herein by referenced in its entirety.

FIELD OF THE INVENTION

The present invention relates to an electrical connector, more specifically to a connector suitable for use in applications with higher mating cycles.

BACKGROUND

Connectors are commonly provided for applications where cycle times are low. For example, many input/output (IO) connectors are expected to undergo relatively few mating cycles. Certain applications, however, require substantially more mating cycles. Portable electronic devices, such as laptops and cellular phones for example, may undergo multiple mating cycles a day due to their power requirements. Similarly, medical devices may require at least one, if not more, mating cycles a day. Over a two year or three period this can cause a connector to experience more than 1000 mating cycles.

Existing, somewhat standards methods of addressing the need for a connector to survive a higher number of mating cycles have been to use more durable (and often more expensive) platings or wider contact areas. This becomes problematic, however, when viewed in light of the constant pressure to provide smaller devices and reduce costs. Magnetic interfaces have also been contemplated. For example, US Publication No. 2010/0197148 discloses the concept of providing a magnetic in a pocket, the magnet configured to press a flex circuit so that the flex circuit makes electrical connection with contact on an opposing side of the mating interface. In addition, certain designs have suggested the simple use of a magnet connection between two stationary contacts. Neither design, however, is particularly suitable for an application where one housing engages a second housing in a sliding manner. Therefore, certain individuals would appreciate further improvements to connectors suitable for high mating cycles.

SUMMARY

A connector includes a housing and a terminal supported by the housing. The terminal includes an aperture positioned adjacent a pocket. Positioned in the pocket is a ball. When the connector is positioned adjacent a magnetic attraction element provided by a mating connector, the ball is attracted to the magnet attraction element and configured to partially extend through the aperture so as to engage a contact on an opposing connector, thus providing an electrical connection between the terminal and the contact.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which:

FIG. 3 is a front perspective view of one of the connectors;

FIG. 4 is a rear perspective exploded view of the connector of FIG. 3;

FIG. 5 is a rear perspective view of the connector of FIG. 3;

DETAILED DESCRIPTION OF THE ILLUSTRATED EMBODIMENTS

Figure 1:
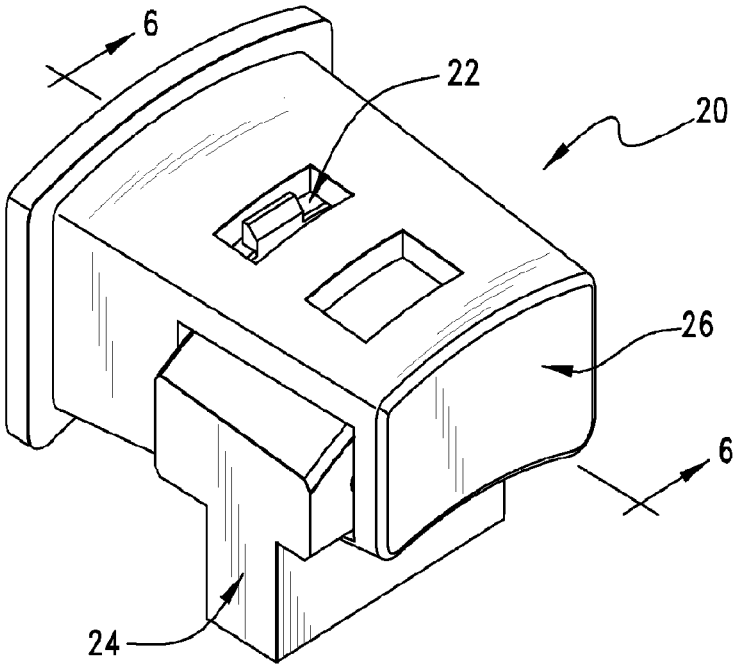
FIG. 1 is a rear perspective view of the power connector which is formed of first and second connectors mounted in a housing.

While the invention may be susceptible to embodiment in different forms, there are shown in the drawings, and herein will be described in detail, certain embodiments with the understanding that the present disclosure is to be considered exemplary and is not intended to limit the invention to that as illustrated and described herein. Therefore, unless otherwise noted, features disclosed herein may be combined together to form additional combinations that were not otherwise shown for purposes of brevity. The terms top, bottom, upper, lower and the like are used herein for convenience in describing the present invention and do not denote a required orientation during use.

As depicted, a power connector 20 includes a pair of connectors 22, 24 which are mated together via a dielectric housing 26. The connectors 22, 24 can be used to transmit power or signals, as desired. Features on the connector 22 are configured to provide for the ability to have a high number of mating cycles with connector 24 while providing an effective electrical connection. It should be noted that many other housing configurations are possible while still providing the benefits depicted.

Figure 2:
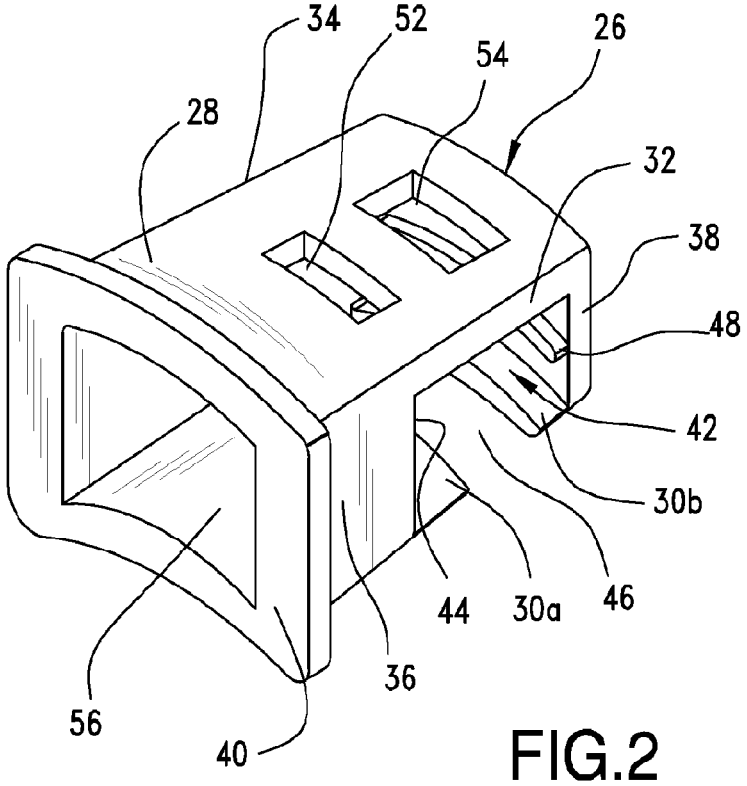
FIG. 2 is a front perspective view of the housing.

The dielectric housing 26, FIG. 2, is formed from an upper wall 28, a pair of lower walls 30*a*, 30*b*, a pair of side walls 32, 34 and front and rear walls 36, 38. Side wall 32 connects the front wall 36 to the rear wall 38. Side wall 34 connects the front wall 36 to the rear wall 38 and connects the upper wall 28 to the lower walls 30*a*, 30*b*. Lower wall 30*a* extends rearwardly from the front wall 36 and lower wall 30*b* extends forwardly from the rear wall 38. The front wall 36 is thickened relative to the remainder of the walls 28, 30*a*, 30*b*, 32, 34 and 38. The upper wall 28, the lower walls 30*a*, 30*b* and the lower end of the front wall 36 can be arched if desired. A flange 40 extends outwardly from the front edge of the front wall 36 around its perimeter.

A cavity 42 is formed in the housing 26 and has a first entrance opening 44 and a second entrance opening 46. The cavity 42 is defined by the rear surface of the front wall 36, the inner surface of the side walls 32, 34 the front surface of the rear wall 38 and the upper surface of the lower walls 30*a*, 30*b*. The first entrance opening 44 corresponds in size to a side of the cavity 42 and is defined by the rear edge of the front wall 36, the lower edge of the side wall 32, the front edge of the rear wall 38 and the upper edges of the lower walls 30*a*, 30*b*. The second entrance opening 46 is provided by the space between the bottom walls 30*a*, 30*b*. The second entrance opening 46 is smaller than the first entrance opening 44. Connector 24 is insertable into the cavity 42 as discussed herein. An elongated protrusion 48 extends forwardly from the front surface of the rear wall 38 along its width. The protrusion 48 forms a key which mates with a corresponding keyway 50 on the connector 24 as described herein. The protrusion 48 is preferably arched, however, it may be linear.

A pair of slots 52, 54 are provided through the upper wall 28 and are in communication with the cavity 42. A passageway 56 is formed through the thickened front wall 36 and is in communication with the cavity 42. The front edge of the passageway 56 forms an entrance opening 57 which is perpendicular to the entrance opening 44. The upper and lower surfaces of the passageway 56 are preferably arched and preferably taper inwardly from the front end of the passageway 56 to the rear end of the passageway 56. If desired, the side surfaces of the passageway 56 may taper inwardly from the front end of the passageway 56 to the rear end of the passageway 56. The passageway 56 is smaller in width than the cavity 42. Connector 22 is insertable into the passageway 56 as discussed herein.

Connector 22, FIGS. 3-5, has a dielectric body formed from an upper wall 58, a lower wall 60, a pair of side walls 62, 64 connecting the outer edges of the upper and lower walls 58, 60 together, and a rear wall 66 connecting the rear edges of the upper, lower and side walls 58, 60, 62, 64 together. The outer surfaces of the walls 58, 60, 62, 64 minors the shape of the surfaces which form the passageway 56. The inner surfaces of the walls 58, 60, 62, 64, 66 define a cavity 68 which has an entrance opening 70 at the front edges of the upper, lower and side walls 58, 60, 62, 64.

A protrusion 72 extends upwardly from the upper wall 58 at its rear end. The protrusion 72 has a chamfered surface 74 along its rear end and is capable of being inserted into slot 52 when the connector 22 is mounted in the housing 24. The rear wall 66 has a plurality of spaced apart mounting flanges 76 extending perpendicularly therefrom and forwardly from its front surface into the cavity 68. A slot 78 is provided through the rear wall 66 directly above each mounting flange 76. A recess 79 is provided in the rear surface of rear wall 66 directly below each slot 78. A pocket 80 is provided in the center of the first recess 79.

Figure 6:
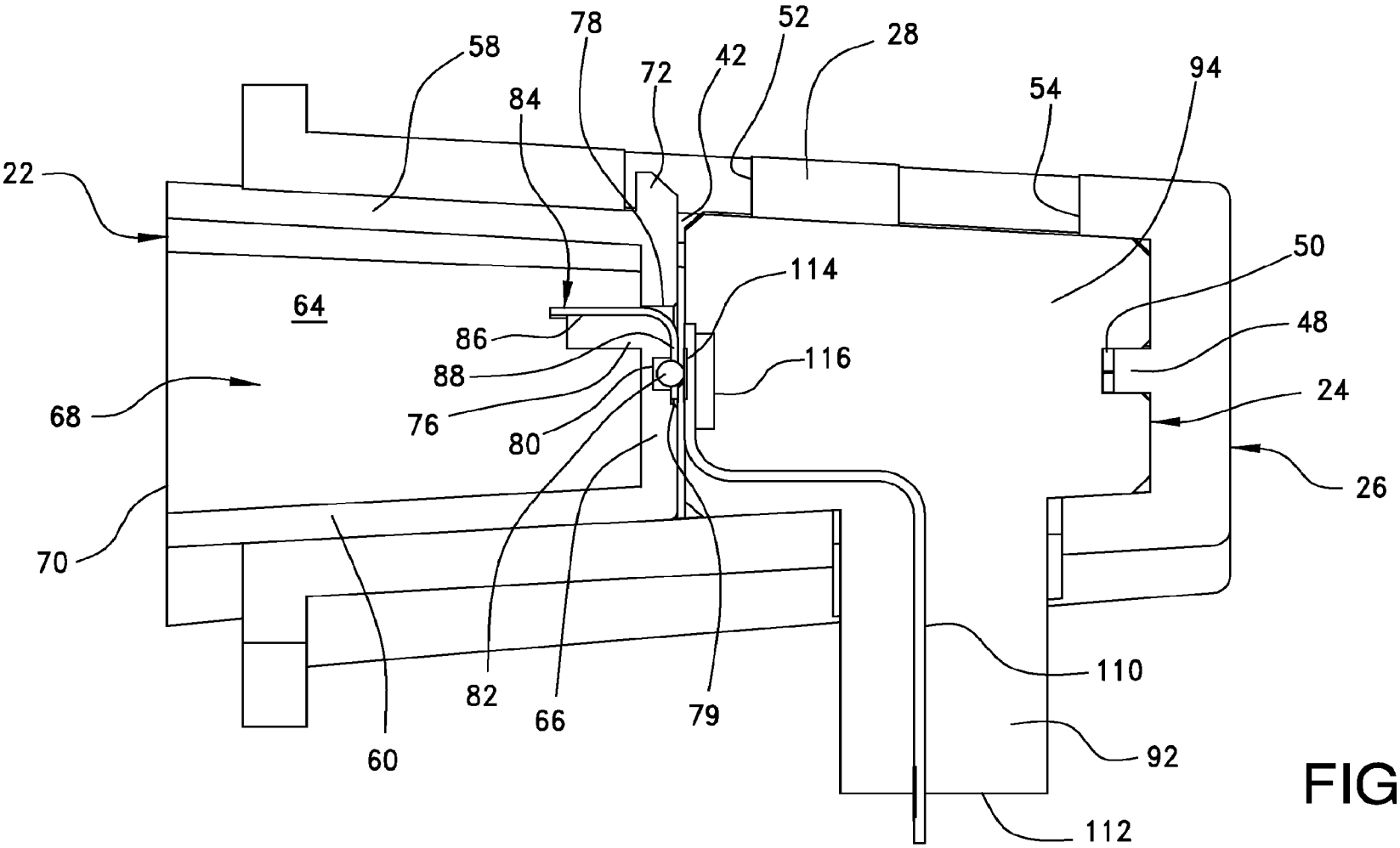
FIG. 6 is a cross-sectional view of the power connector along line 6-6 of FIG. 1.
Figure 7:
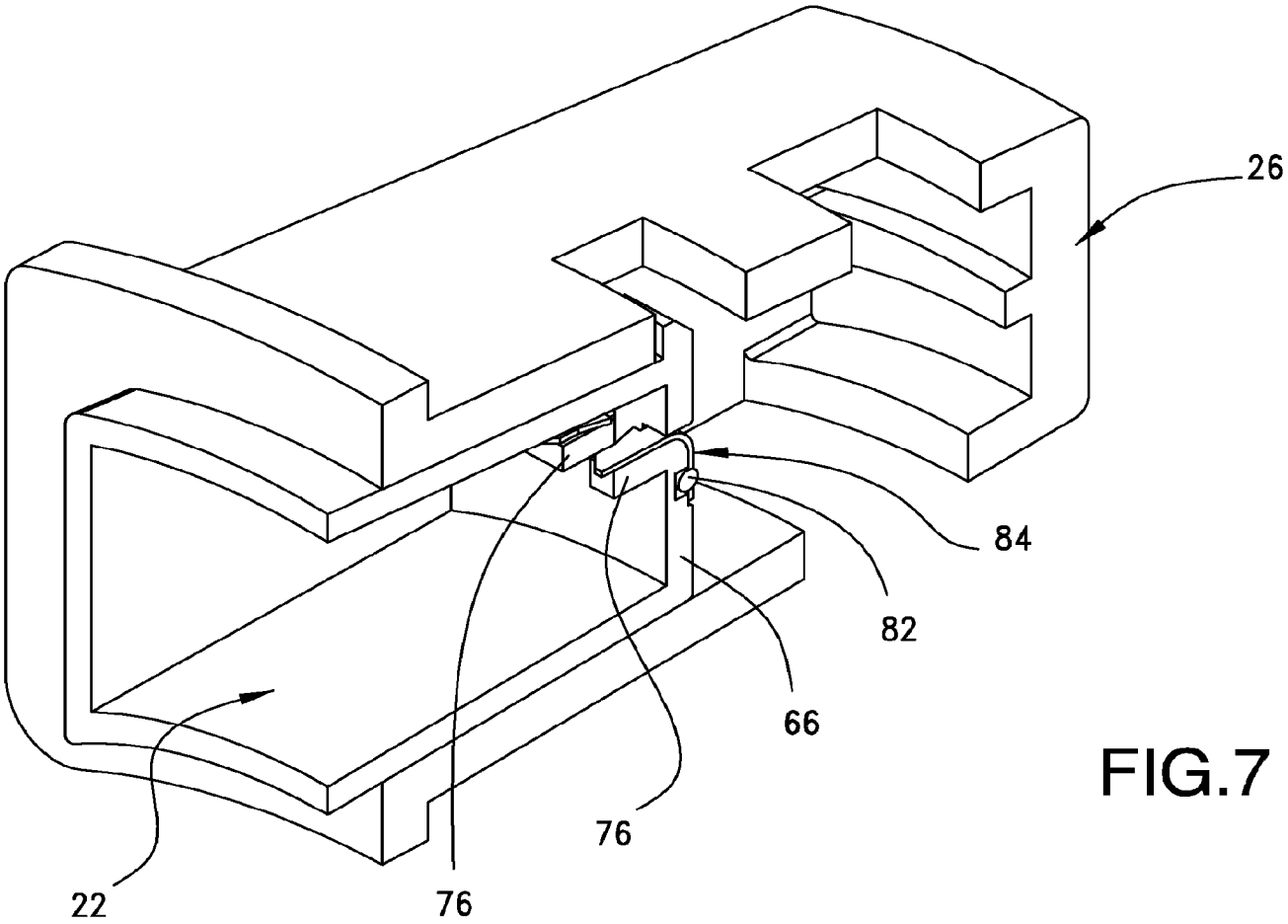
FIG. 7 is a cut away perspective view of the connector of FIG. 3 and the housing of FIG. 2 shown mated together.
Figure 8:
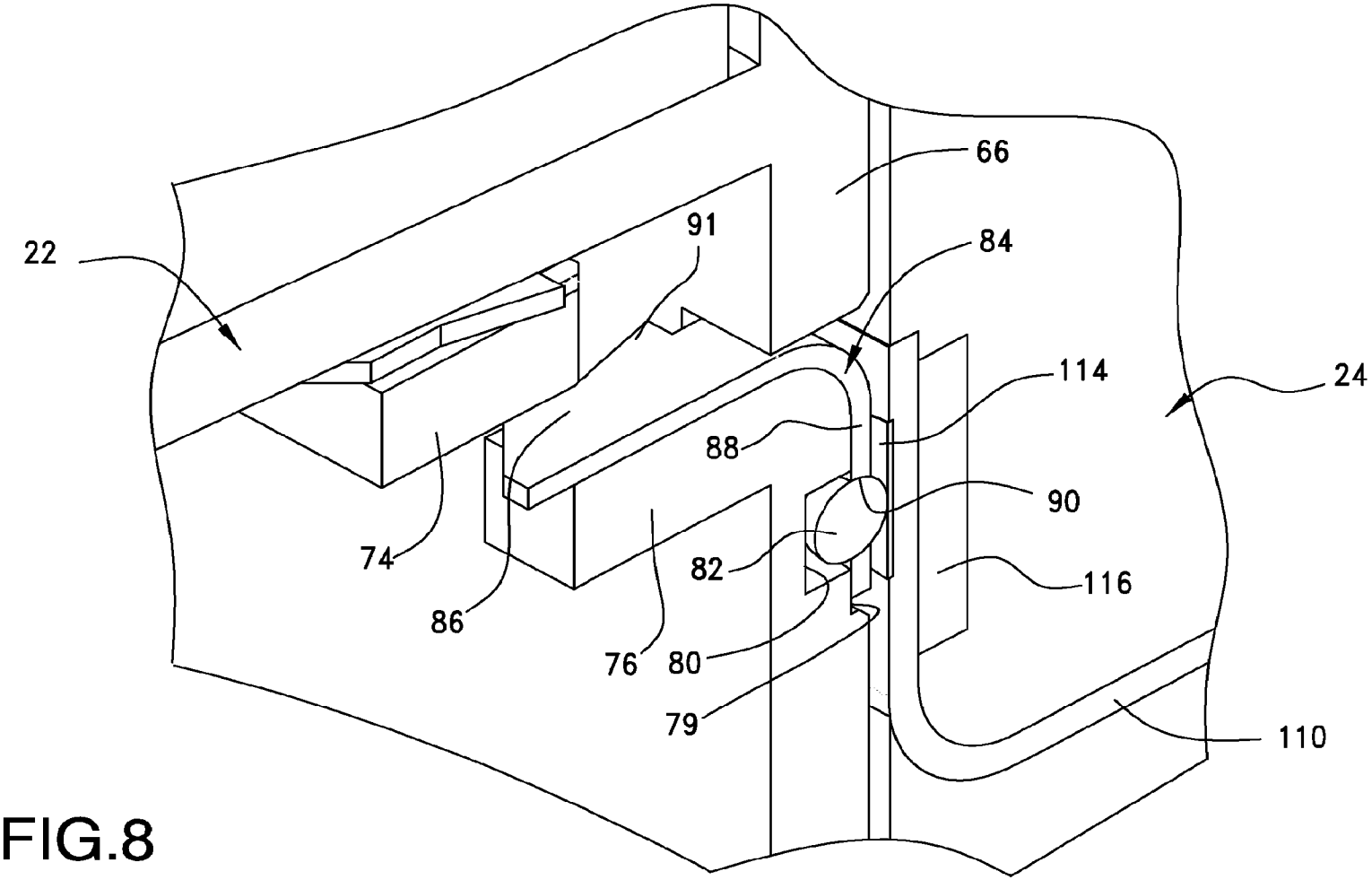
FIG. 8 is a cut-away perspective view of the power connector shown mated together.

A ball 82, FIGS. 6-8, is mounted in each pocket 80. Each ball 82 can be coated with a conductive coating, such as a thin layer of copper so as to help control impedance.

A terminal 84 is mounted through each slot 78 and abuts against the respective mounting flange 76 and the rear surface of the rear wall 66. As depicted, each terminal 84 includes an upper leg 86 connected to a lower leg 88. The lower leg 88 of each terminal 84 can be perpendicular to the upper leg 86. Each lower leg 88 has an aperture 90 provided therethrough. Respective terminals 84 are mounted in respective slots 78 such that the upper leg 86 extends through the slot 78 and sits on its associated mounting flange 76, and the lower leg 88 is seated within the respective first recess 79 and covers the associated pocket 80. The ball 82 rests in the pocket and can partially extend through the aperture 90, but cannot completely pass therethrough. As a result, the balls 82 are trapped in the second recesses 80 by the lower legs 88. Each upper leg 86 is depicted as including a retention feature 91 for engaging the front surface of the rear wall 66 to prevent the removal of the terminals 84 once attached to the connector 24.

Figure 9:
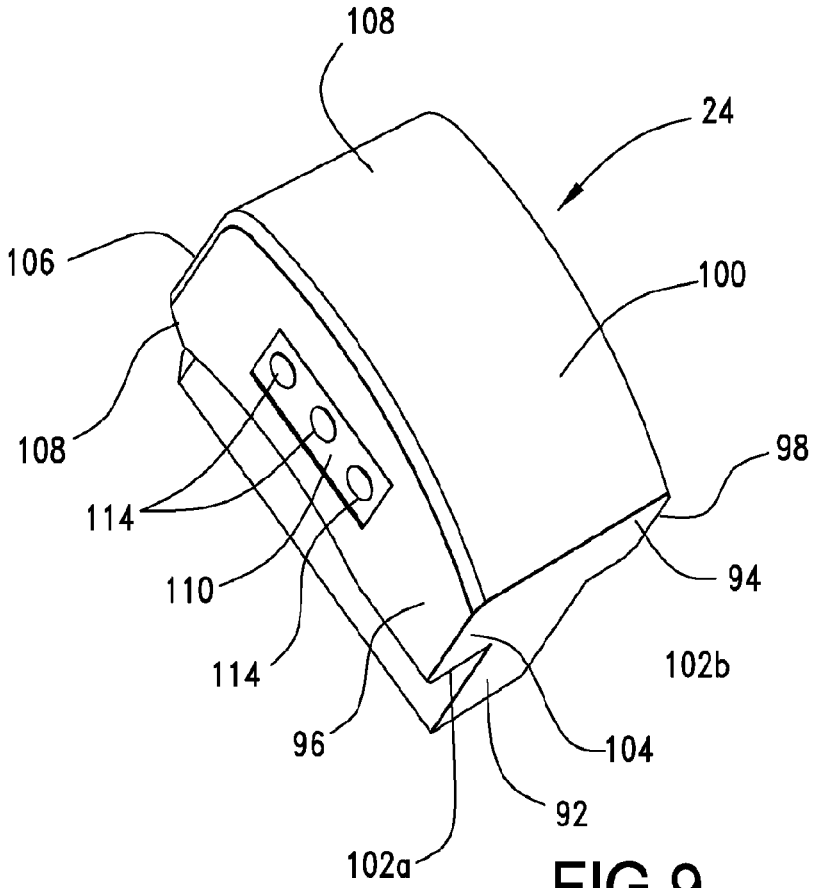
FIG. 9 is a front perspective view of the other connector.
Figure 10:
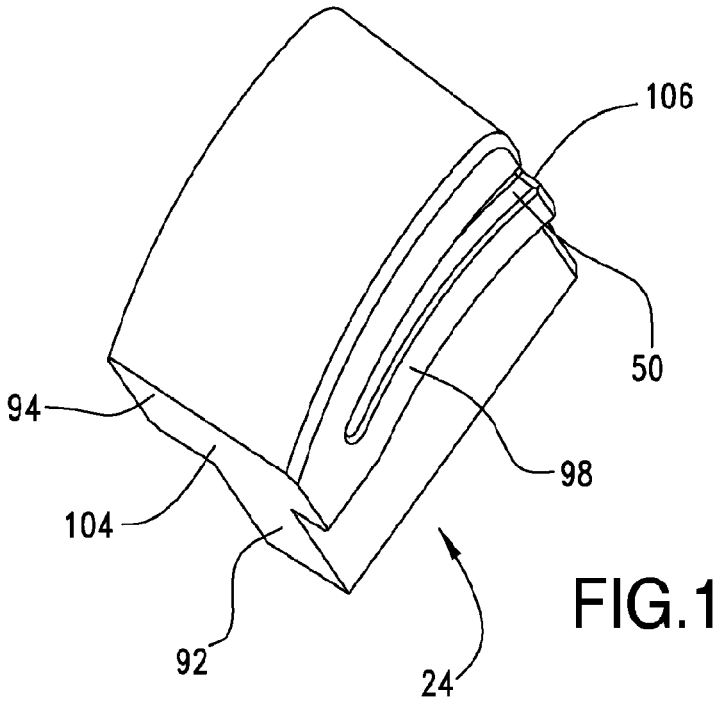
FIG. 10 is a front perspective view of the connector of FIG. 9.
Figure 11:
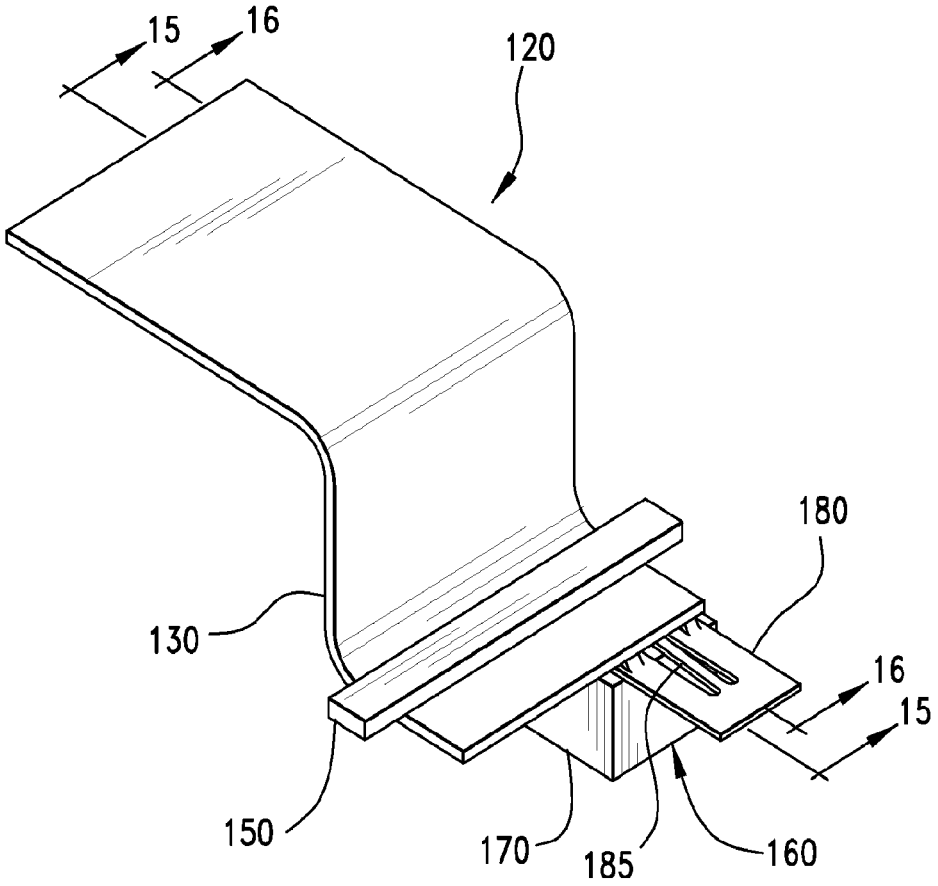
FIG. 11 is a perspective view of an embodiment of a simplified embodiment of a connector system.
Figure 12:
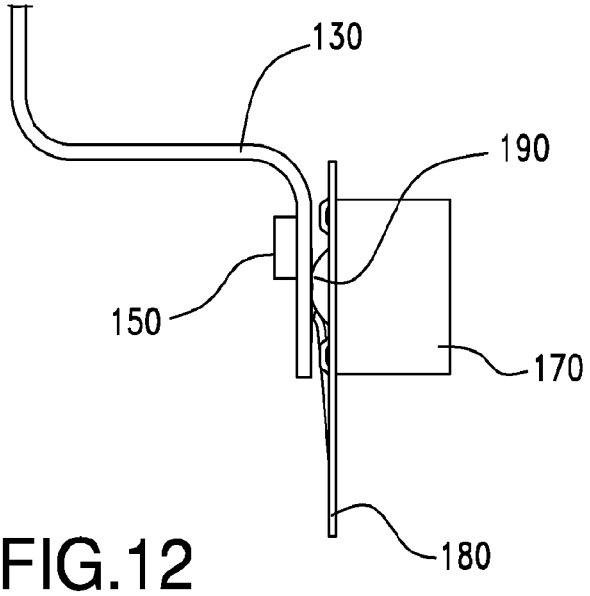
FIG. 12 is an elevated side view of the embodiment depicted in FIG. 11.
Figure 13:
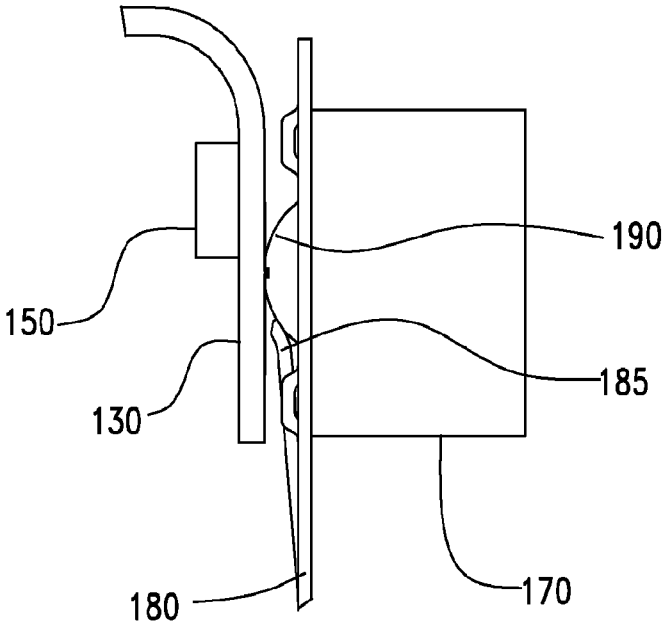
FIG. 13 is an enlarged view of the embodiment depicted in FIG. 11.
Figure 14:
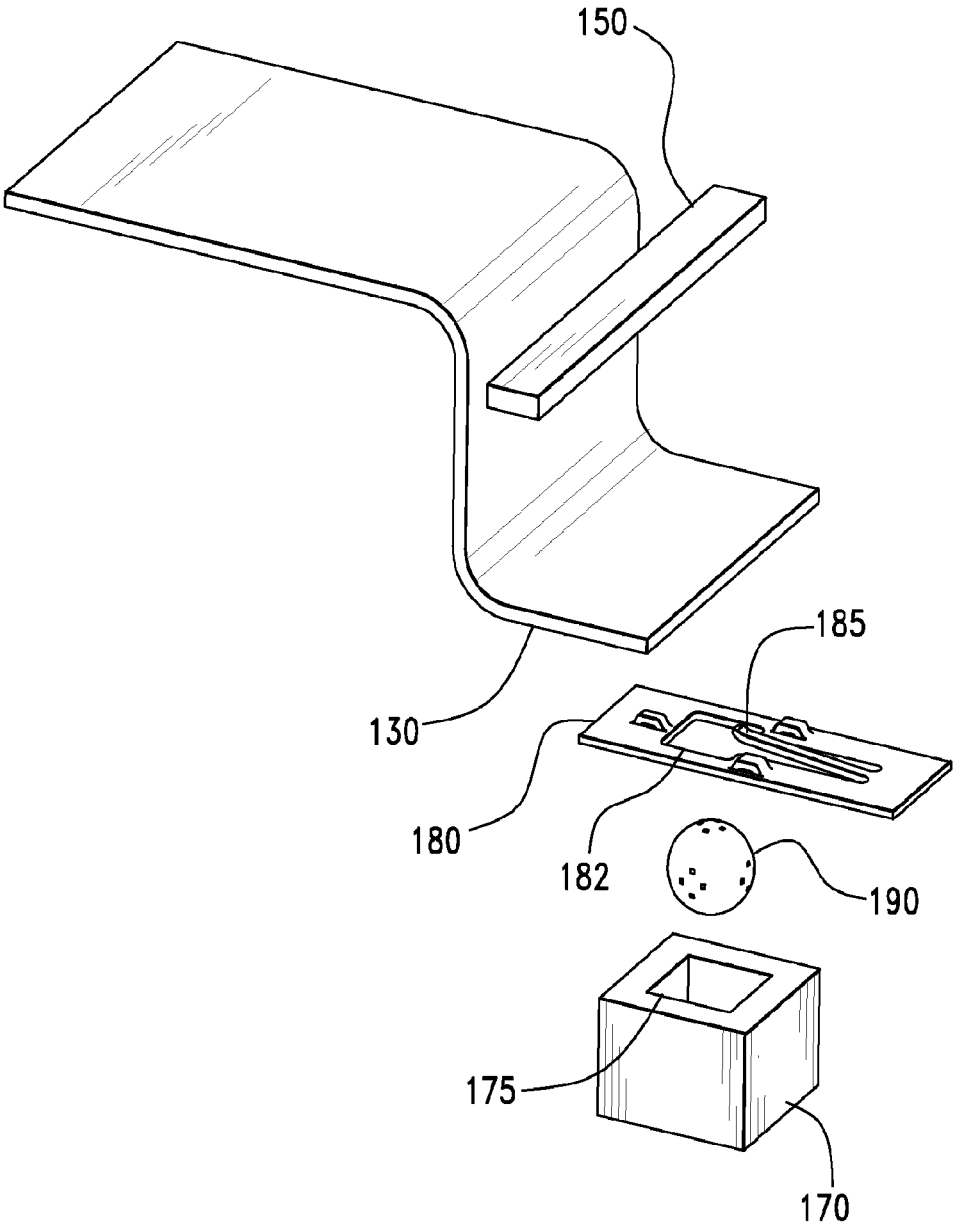
FIG. 14 is an exploded perspective view of the embodiment depicted in FIG. 11.
Figure 15:
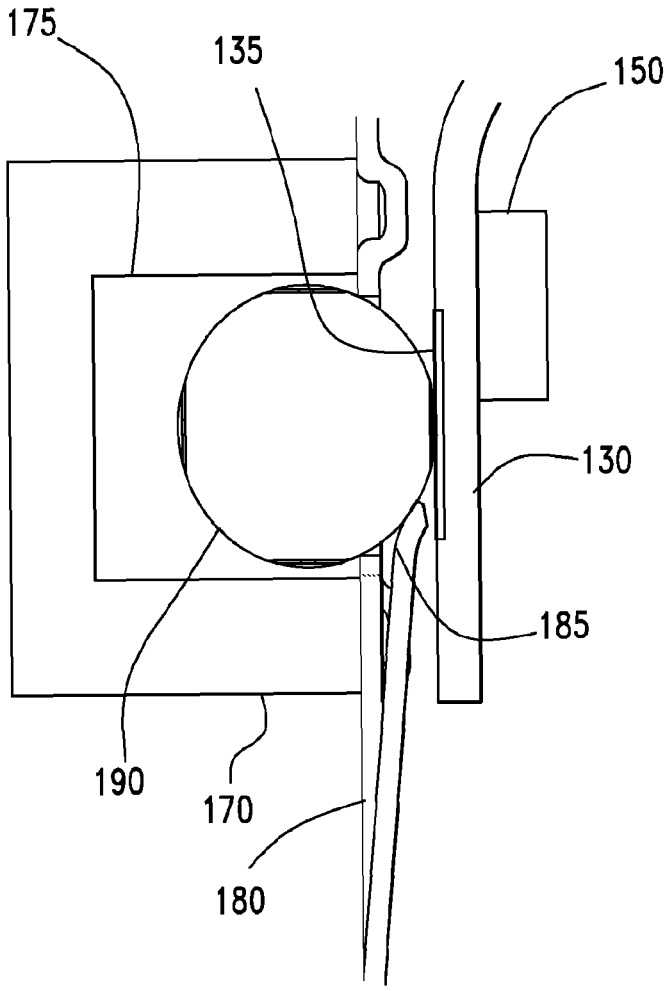
FIG. 15 is a perspective cross-sectional view taken along the line 15-15 in FIG. 11.
Figure 16:
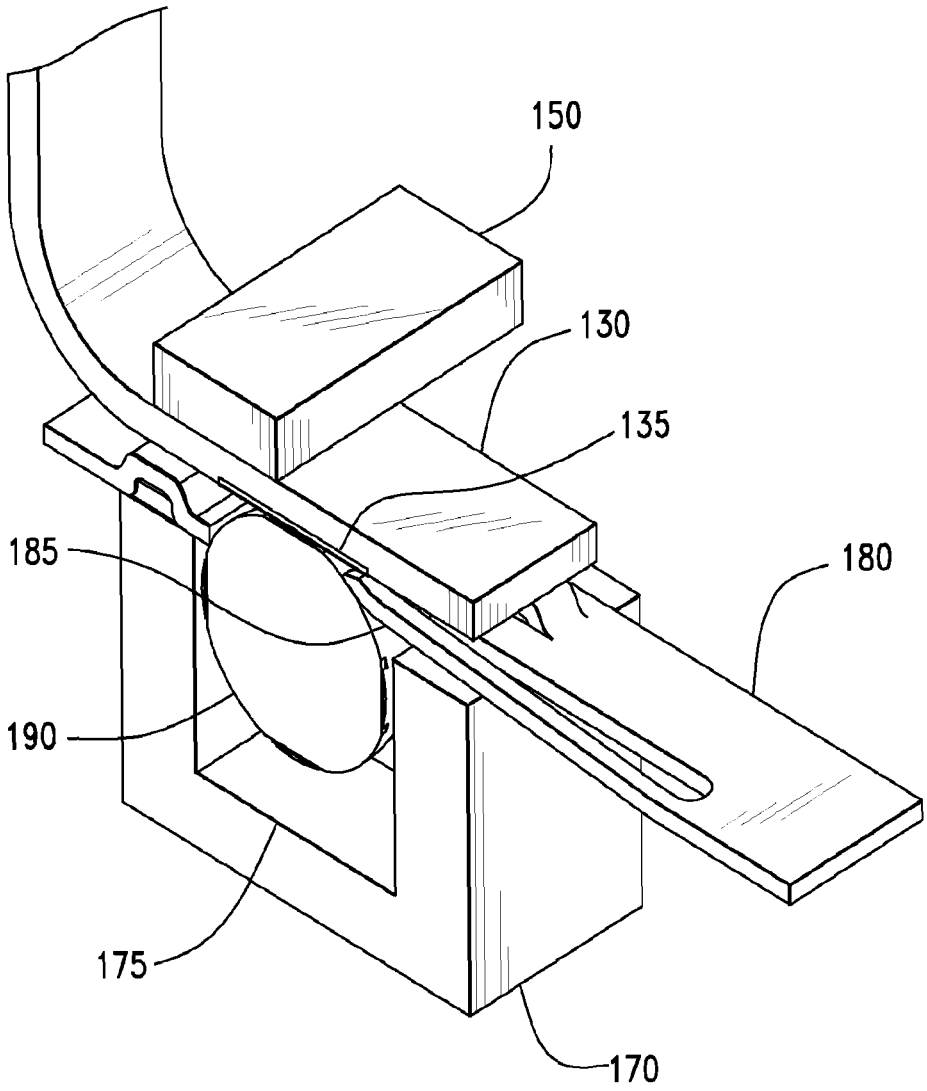
FIG. 16 is a perspective cross-sectional view taken along the line 16-16 in FIG. 11.
Figure 17:
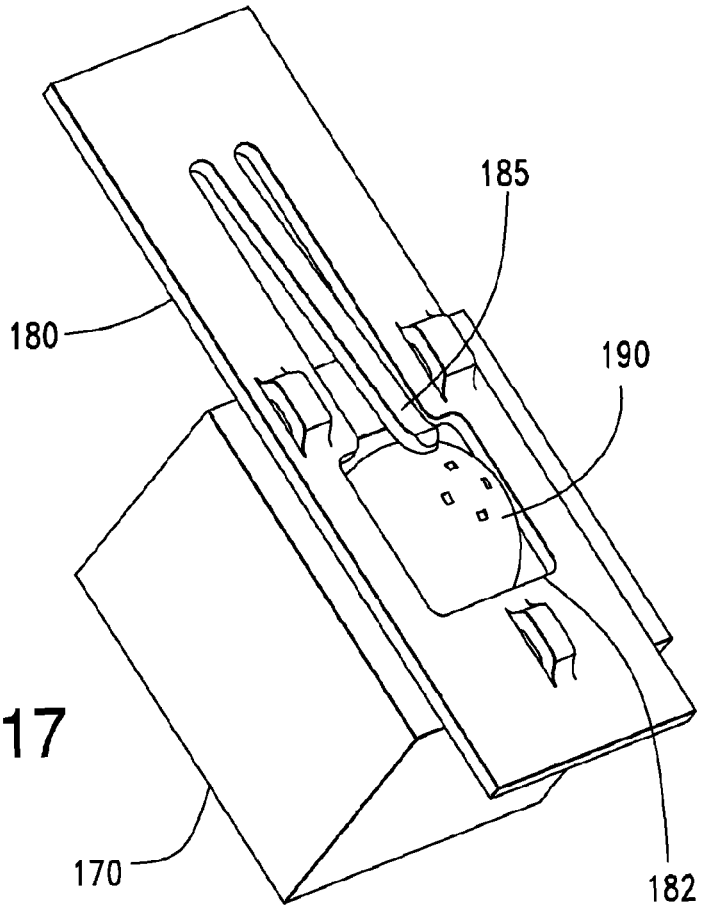
FIG. 17 is a simplified perspective view of an embodiment of a connector.

Connector 24, FIGS. 8-10, is generally T-shaped in cross-section such that a lower wall 92 extends downwardly from a midpoint of an upper wall 94. Each wall 92, 94 is dielectric. The upper wall 94 is defined by a front surface 96, a rear surface 98, an upper surface 100, lower surfaces 102*a*, 102*b* on each side of the lower wall 92, and opposite side surfaces 104, 106. The shape of the upper surface 100 mirrors the shape of the surface on the underside of the upper wall 28 of the housing 24, and thus is preferably arched. The shapes of the lower surfaces 102*a*, 102*b* mirror the shapes of the upper surfaces of the lower walls 30*a*, 30*b*, and thus are preferably arched. The rear surface 98 has the elongated keyway 50 which commences at side surface 106 but terminates before side surface 104. The upper wall 94 is sized to fill the cavity 48 and the lower wall 92 is sized to fill the second entrance opening 46. The leading edges of the upper wall 94 preferably have rounded or chamfered corners 108.

The connector 24 has a flexible circuit 110 provided therein. The flexible circuit 110 commences at the front surface 96 of the upper wall 94, extends through the connector 24 and exits the lower surface 112 of the lower wall 92. The flexible circuit 110 has a plurality of contact pads 114, shown as three in FIG. 9, provided on the front surface 96 of the upper wall 94. As shown in FIG. 8, a magnetic attraction member 116, which can be formed from ferrite-based material if the ball 82 is magnetic, is supported by the upper wall 94 and is aligned with a corresponding contact pad 114.

To assemble the connectors 22, 24 with each other and with the housing 26, connector 22 is first inserted into the housing 26 by inserting the rear end of the connector 22 into the passageway 56 and pushing the connector 22 into the housing 26 until the protrusion 72 enters into the slot 52 in the top wall 28. The balls 82 may partially extend into the cavity 42.

Next, the connector 24 is slid into the cavity 48 with the rounded or chamfered corners 108 of the upper wall 94 entering through the first entrance opening 44 and into the cavity 48 and the second wall 92 entering through an end of the second entrance opening 46 and into the second entrance opening 46. The second wall 92 extends downwardly from the second entrance opening 46. The protrusion 48 on the housing 26 mates with the keyway 50 on the connector 24 to ensure that the connector 24 is inserted in the proper direction into the housing 26. Once the front wall 96 engages the balls 82, the balls 82 roll along front wall 96 of the connector 24. This reduces wear on the contact pads 114 since the rolling action of the balls 82 minimizes the frictional wear between the connectors 22, 24 during mating and during separation of the connectors 22, 24. Since the walls 28, 30*a*, 30*b* of the housing 26 and the walls 100, 102*a*, 102*b* of the connector 24 are arched, the connector 24 pivots around a centerpoint of the housing 26 as it is inserted therein.

When the connector 24 is completely inserted into the housing 26, the magnetic attraction member 116 attracts the ball 82 which causes the ball 82 to engage the conductive pad 114 to complete the electrical connection between the terminal 84 and the conductive pad 114. If necessary, the second legs 88 of the terminals 84 can flex away from the rear wall 66 of the connector 22 to compensate for any tolerances between the terminal 84 and the conductive pad 114, which is expected to be stationary, result from manufacturing and/or design constraints. Therefore, power can flow from a source (not shown) through the contact pads 114, through the conductive balls 82, and through the terminals 84 so as to allow for an electrical connection that can be reliably made. The conductive coating on the balls 82 reduces electrical resistance and improves conductivity.

As can be appreciated, the ball 82 can be one of magnetic or ferrite based and the plate 116 can be the other. In addition, it is to be understood that both can be magnetic based. While a flexible circuit 110 is described as supporting the contact pad 114, the contact pad can readily be provided by a convention terminal.

While the protrusion 48 is shown on the housing 26 and the keyway 50 is shown on the connector 24, the positions of these components can be reversed. Also, while the connectors 22, 24 and the housing 26 are shown with arched walls, the walls can be flat, if desired.

Turning to FIG. 11-17, a simplified embodiment of a connector system 120 is depicted. A first connector 160 includes a housing 170 that supports a terminal 180. The housing 170 includes a pocket 175 that supports a ball 190, which is preferably spherical in shape. The terminal 180 includes an aperture 182. Positioned in the aperture 182 is a finger 185. In operation, the aperture 182 is placed adjacent a second connector that includes a contact 135 positioned adjacent a magnetic attraction member 150. The ball 190 is urged toward the magnetic attraction member 150 and thus completes an electrical circuit between the terminal 180 and the contact 135.

It should be noted that in an embodiment the contact 135 is supported by a member 130, which could be positioned on a housing (not shown). The contact 135 could be a second terminal supported by an insulative housing with a magnetic attraction member 150 positioned adjacent the contact 135. For example, the contact could be a copper-based terminal with a plating. Alternatively, the magnetic attraction member 150 could be used as the terminal (thus combining the contact and the magnet attraction member) and could be plated to help prevent corrosion on the surface of the magnetic attraction member 150. As can be appreciated, the magnetic attraction member 150 can be a ferrite-based substance if the ball 190 is magnetic or the magnetic attraction member 150 could be magnetic if the ball 190 was ferrite-based. In addition, both the ball 190 and the magnetic attraction member 150 could be formed of magnetic material if desired.

To help ensure the electrical connection between the terminal 180 and the contact 135 is maintained, the ball 190 presses against the finger 185 and deflects it when the ball 190 moves toward the contact 135. In this way, tolerances between the terminal 180 and the contact 135 are accounted for. Of course, as noted above, the terminal 180 could also deflect toward the contact to account for possible tolerances. Alternatively, the first and second terminal could be manufactured such that tolerances were not an issue. However, it is generally expected that such careful manufacturing would be overly expensive and therefore having some degree of flexibility to ensure tolerances are managed is desired. It can be beneficial to have the pocket sized so that the ball is kept in close proximity to the aperture.

Figure 18:
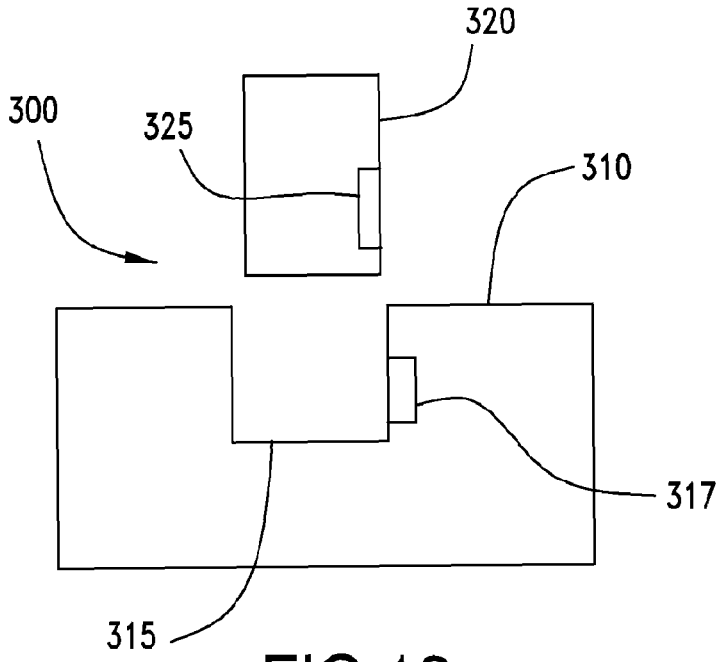
FIG. 18 is a schematic view of an embodiment of a connector system.

FIG. 18 illustrates a schematic representation of a connector system 300. A first connector 310 includes a first connecting portion 317 and second connector 320 includes a second connecting portion 325. The first connector is configured to mate with the second connector such that the first and second connecting portions 317, 325 are aligned with each other. One of the first and second connecting portions includes a terminal with an aperture positioned adjacent a pocket and the other connecting portion includes a contact aligned magnetic attraction member. The pocket includes a ball that is configured so that it can extend partially through the aperture and is attracted to the magnetic attraction member. Thus, in a manner similar to that discussed above, mating of the first connector 310 and second connector 320 causes the ball to create an electrical connection between the terminal and the contact.

It should be noted that the connector system is suitable for use in a wide range of configurations. For example, a sliding engagement between the first and second connector is not required unless otherwise noted.

While certain embodiments are shown and described, it is envisioned that those skilled in the art may devise various modifications without departing from the spirit and scope of the appended claims.

The invention claimed is:

1. A connector, comprising:

a housing with a pocket;

a terminal supported by the housing, the terminal including an aperture aligned with the pocket;

a ball positioned in the pocket, the ball being one of a magnet or a ferrite-based material;

the terminal configured to restrain the ball in the pocket, wherein the ball is sized so as to be able to partially extend through the aperture so that in operation, position of the aperture adjacent a contact and a magnetic attraction member causes the ball to extend through the aperture.

2. The connector of claim 1, wherein the terminal is configured to flex when the ball is attracted to the contact.

3. The connector of claim 1, wherein the terminal includes a finger positioned in the aperture, the figure configured to flex toward the contact when the ball is attracted to the contact.

4. A connector system, comprising:

a first housing including a pocket;

a first terminal with an aperture supported by the housing, the aperture aligned with the pocket;

a ball positioned in the pocket;

a second housing;

a contact supported by the second housing; and a magnetic attraction member aligned with the contact, at least one of the ball and the magnetic attraction member being a magnet and the other one being one of a magnet and a ferrite-based material, wherein the first housing is positioned adjacent the second housing so that the aperture is aligned with the contact and the ball is attracted to the magnetic attraction member such that an electrical connection is formed between the terminal and the contact.

5. The connector system of claim 4, wherein the ball is a magnet.

6. The connector system of claim 4, wherein the terminal is configured to flex toward the contact.

7. The connector system of claim 4, wherein the terminal includes a finger positioned in the aperture, the finger configured to flex and maintain electrical contact between the terminal and the ball over a range of positions of the ball.

* * * * *